US006283122B1

(12) United States Patent
Adahan

(10) Patent No.: US 6,283,122 B1
(45) Date of Patent: Sep. 4, 2001

(54) EXHALATION VALVE FOR RESPIRATOR

(75) Inventor: Carmeli Adahan, Jerusalem (IL)

(73) Assignee: Flight Medical Ltd., Jerusalem (IL)

( * ) Notice: Subject to any disclaimer, the term of this patent is extended or adjusted under 35 U.S.C. 154(b) by 0 days.

(21) Appl. No.: 09/266,162

(22) Filed: Mar. 10, 1999

(51) Int. Cl.[7] ..... A62B 9/02

(52) U.S. Cl. ..... 128/205.24; 128/204.23

(58) Field of Search ..... 128/205.24, 204.21, 128/204.23, 204.26, 202.22; 137/494, 505.47, 487.5; 251/30.01, 58, 129.01, 129.15, 129.18, 129.2

(56) References Cited

U.S. PATENT DOCUMENTS

| | | | | |
|---|---|---|---|---|
| 4,190,045 | * | 2/1980 | Bartels | 128/205.24 |
| 4,454,893 | * | 6/1984 | Orchard | 137/494 |
| 4,699,137 | * | 10/1987 | Schroeder | 128/205.24 |
| 4,712,580 | * | 12/1987 | Gilman et al. | 137/512.15 |
| 4,717,117 | | 1/1988 | Cook | 251/61.1 |
| 5,020,532 | * | 6/1991 | Mahoney et al. | 128/205.24 |
| 5,127,400 | * | 7/1992 | DeVries et al. | 128/205.24 |
| 5,562,122 | * | 10/1996 | Lundback | 137/509 |
| 5,683,232 | * | 11/1997 | Adhan | 128/205.24 |
| 5,687,767 | * | 11/1997 | Bowers | 128/205.24 |
| 5,771,884 | * | 6/1998 | Yarnall et al. | 128/205.24 |
| 5,836,302 | * | 11/1998 | Homuth et al. | 128/205.23 |
| 5,937,855 | * | 8/1999 | Zdrojkowski et al. | 128/205.24 |
| 5,950,623 | * | 9/1999 | Michell | 128/205.24 |
| 6,073,630 | * | 6/2000 | Adahan | 128/205.24 |

* cited by examiner

*Primary Examiner*—Aaron J. Lewis
*Assistant Examiner*—Teena Mitchell
(74) *Attorney, Agent, or Firm*—Davidson, Davidson & Kappel, LLC

(57) ABSTRACT

An exhalation assembly which includes a hollow flow-through body, having an air inlet port and an air outlet port. The inlet port is arranged to receive air for supplying to a patient, and the air outlet port is arranged to provide air to a patient. The device also includes an exhalation valve connected to the flow-through body, for facilitating selectable exhalation by a patient to whom air is being supplied. The exhalation valve includes an air exhalation port arranged to permit therethrough an outflow of exhaled air and a valve member arranged to selectably cover the exhalation port in response to a closure pressure applied thereto, and to uncover the exhalation port in response to an exhalation pressure applied thereto from the flow-through body through the exhalation port Also included is a pressure source for selectably applying a closure pressure to the valve member, wherein the valve member is operative to cover the exhalation port in response to at least a minimum closure pressure which has a smaller magnitude than an opposing exhalation pressure.

17 Claims, 3 Drawing Sheets

EXHALATION VALVE FOR RESPIRATOR

FIELD OF THE INVENTION

The present invention relates to exhalation valves in general, and to the use of these valves in medical respirators, in particular.

BACKGROUND OF THE INVENTION

Exhalation valves are an essential part of respiration devices. They carry air or oxygen to the patient and carbon dioxide from the patient to atmosphere. The function of the exhalation valve in respiration devices is to allow a patients exhaled breath to vent to atmosphere, while preventing gas being supplied to the patient from venting to atmosphere before it reaches the patient. Exhalation valves currently In the art have a number of drawbacks.

Prior art valves generally are unable to function accurately as pressure control devices since they usually operate in two extreme positions only; namely open or closed. These valves are not well suited for any incremental operation.

Valves in the current art usually perform with a noticeable lag time between initialization of the respiration process and response time of the valves.

Exhalation valves known in the prior art exhibit a linear relationship between the control signal and the servo mechanism. They are noisy in operation and tend to malfunction. This is generally due to blockage of exhalation discharge to atmosphere, improper assembly after disassembly for cleaning and or sterilization, or a combination of these factors.

An example of a valve in the current art may be found in U.S. Pat. No. 4,717,117 to Cook entitled "Vacuum Valve Using Improved Diaphragm." The subject valve employs a flexible diaphragm for opening and closing an exhalation port, and exhibits most of the drawbacks mentioned above.

SUMMARY OF THE INVENTION

Accordingly, it is an object of the present invention to provide a valve which is devoid of the abovementioned deficiencies found in the prior art.

There is thus provided, in accordance with a preferred embodiment of the invention, an exhalation assembly which includes a hollow flow-through body, having an air inlet port and an air outlet port. The inlet port is arranged to receive air for supplying to a patient and the air outlet port is arranged to provide air to a patient.

The device also includes an exhalation valve connected to the flow-through body, for facilitating selectable exhalation by a patient to whom air is being supplied. The exhalation valve includes an air exhalation port arranged to permit therethrough an outflow of exhaled air and a valve member arranged to selectably cover the exhalation port in response to a closure pressure applied thereto and to uncover the exhalation port in response to an exhalation pressure applied thereto from the flow-through body through the exhalation port.

Also included is a pressure source for selectably applying a closure pressure to the valve member, wherein the valve member is operative to cover the exhalation port in response to at least a minimum closure pressure which has a greater magnitude than an opposing exhalation pressure.

The present embodiment of the invention further includes apparatus wherein the valve member is a flexible diaphragm. The exhalation valve also has a housing formed integrally with the flow-through body, wherein the housing has a closure pressure inlet port associated with a working pressure source, and is arranged so as to receive air from the flow-through body through the exhalation port. The housing further has formed therein first and second diaphragm seating portions configured to support the flexible diaphragm therebetween.

The first valve seating portion is configured to support a first portion of the flexible diaphragm when the flexible diaphragm is in the uncovered position, and the second valve seating portion is configured to support a second portion of the flexible diaphragm when the flexible diaphragm is in the covered position.

The present embodiment of the invention further includes apparatus wherein the first and second portions of the flexible diaphragm, have effective working areas of different magnitudes, such that predetermined first and second transfer force ratios apply across the flexible diaphragm when the diaphragm is moving from the uncovered position to the covered position, and from the covered position to the uncovered position, respectively.

The present embodiment of the invention further includes apparatus wherein the first transfer force ratio is approximately 5:1 and the second transfer force ratio is approximately 8:1.

The present embodiment of the invention further includes apparatus for damping oscillation of the flexible diaphragm. The apparatus for damping includes an added mass formed on the first portion of the flexible diaphragm.

The present embodiment of the invention further includes apparatus wherein the flexible diaphragm has a resonant frequency substantially below the normal range of human hearing.

The present embodiment of the invention further includes a housing portion surrounding the closure pressure inlet port, so as to define together with the flexible diaphragm a servo chamber. The servo chamber housing is constructed with an annular rim member depending therefrom and internal to the servo chamber. The annular rim member includes a shoulder portion and a sidewall portion. The shoulder portion is parallel to the plane in which the flexible diaphragm is mounted and the sidewall portion extends angularly from the shoulder portion.

The present embodiment of the invention further includes apparatus wherein the flexible diaphragm has a central portion of varying thickness, surrounded by an annular portion of generally uniform thickness. The flexible diaphragm is also mounted between an annular rim constructed to retain an edge portion of the diaphragm, and the housing formed with the first and second diaphragm seating portions whereby the flexible diaphragm is supported.

The flexible diaphragm, when moving from the covered position to the uncovered position, undergoes a first lateral displacement towards the closure pressure inlet port, and while undergoing the first lateral displacement, the annular portion of the flexible diaphragm engages the shoulder portion so as to be prevented from further lateral displacement.

The present embodiment of the invention further includes apparatus wherein, while the flexible diaphragm is moving from the covered to the uncovered position, and after the engagement of the annular portion by the shoulder portion, the central portion of the diaphragm is operative to undergo a second further lateral displacement in the same direction as the first lateral displacement. When the flexible diaphragm is in the covered position, the central portion of the flexible diaphragm has an effective working surface whose area is less than the area of the flexible diaphragm.

The present embodiment of the invention further includes apparatus wherein the sidewall portion of the annular rib member delineates an effective volume of the servo chamber together with the flexible diaphragm while the central portion of the flexible diaphragm is undergoing a second further lateral displacement, thereby reducing the working volume of the servo chamber from a first volume defined by the entire area of the flexible diaphragm including the annular portion thereof, to a second smaller volume defined by the central portion of the diaphragm and the sidewall portions. This thereby permits rapid movement of the flexible diaphragm from the covered position to the uncovered operative position due to the lesser amount of air or working fluid necessary to be displaced from the second smaller volume.

The present embodiment of the invention further includes a housing formed about the air exhalation port so as to define a muffling chamber, and operative to permit a flow of exhaled air from the exhalation port to the muffling chamber. The housing that delineates the muffling chamber has formed therein a plurality of recessed discharge slits thereby facilitating discharge of exhaled air.

The present embodiment of the invention further includes apparatus wherein the hollow flow-through body has at least one monitoring port for gas parameters, formed integrally and arranged in gas flow communication therewith. The invention also includes a cover element for selectably dosing the monitoring port The present embodiment of the invention further includes apparatus wherein the flexible diaphragm is responsive to a first closure pressure applied from the pressure source, in conjunction with the second transfer ratio, to determine the magnitude of a first exhalation pressure required to move the flexible diaphragm to the uncovered position. The flexible diaphragm is further operative, in response to at least one further closure pressure having a magnitude different to the first closure pressure and wherein the further closure pressure is operative to determine the magnitude of a further exhalation pressure, the further exhalation pressure having a magnitude different to the first exhalation pressure, required to move the flexible diaphragm to the uncovered position.

BRIEF DESCRIPTION OF THE DRAWINGS

The present invention will be more easily understood and appreciated from the following detailed description, taken in conjunction with the drawings, in which.

DETAILED DESCRIPTION OF A PREFERRED EMBODIMENT

Figure 1:
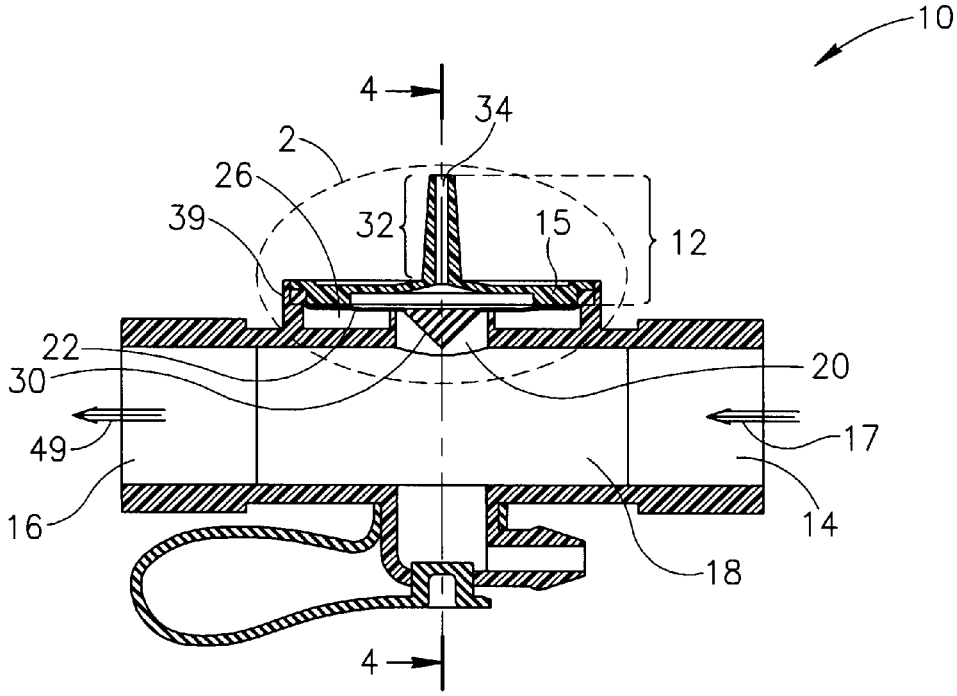
FIG. 1 is a cross-sectional view of an exhalation valve assembly, constructed and operative in accordance with a preferred embodiment of the present invention, illustrated in a closed position.

Referring to FIG. 1, the present invention provides an exhalation assembly, referenced generally 10, used as part of a respiratory breathing circuit. Exhalation assembly 10 includes a hollow flow-through body 18 having an air inlet port 14 and an air outlet port 16, between which a gas can flow freely. A source of compressed air or respirator (not shown), is connected to air inlet port 14 by a suitable mechanical connector (not shown), and air outlet port 16 is configured for connection to a patient (not shown). Air can flow freely, as indicated by arrow 17, along flow-through body 18 from air inlet port 14 to air outlet port 16, hereinafter referred to as "patient port" 16. Flow-through body 18 also has formed therein an air exhalation port 20, referred to below also as "discharge port" 20, which is selectably closable by a flexible diaphragm 22, as described in detail, below. Flexible diaphragm 22, which is composed of a pliant material, such as rubber, latex, silicone, or the like, is selectably movable so as to cover and substantially seal or close discharge port 20 in response to a selectable pressure applied thereto via a servo connection 32 from a suitable pressure source (not shown).

Figure 2:
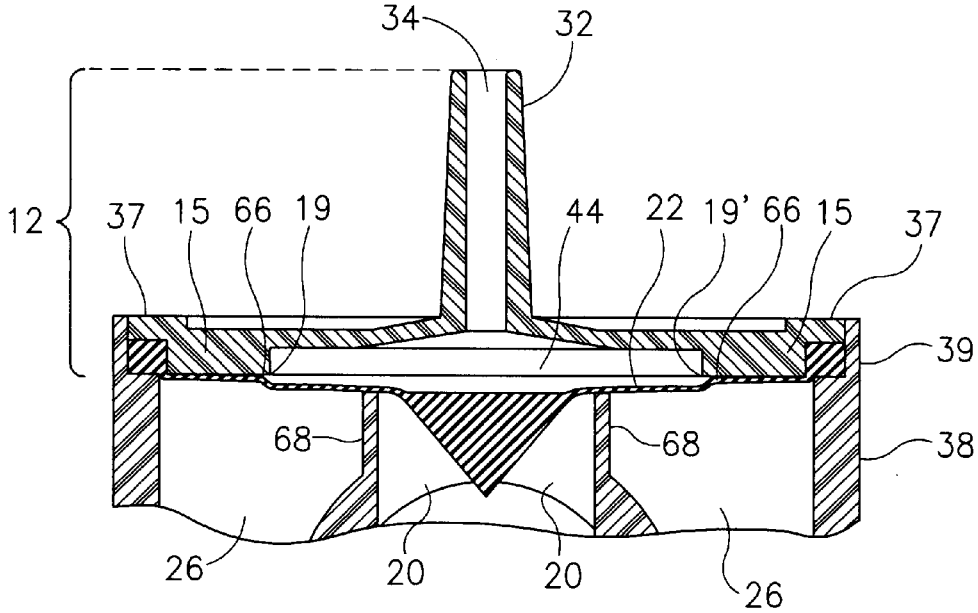
FIG. 2 is an enlarged view of a portion of FIG. 1 seen at 2 showing a flexible diaphragm therein in a closed position.

Referring now to FIG. 2, it is seen that cover member 12 defines with diaphragm 22 a servo chamber 44. For this purpose, cover member 12 has formed therewith a servo inlet 34, illustrated here as nipple-shaped portion 32 of cover member 12. Nipple 32 is configured for connection to a source of pressurized gas (not shown) which serves as a working fluid to provide a working pressure for selectably maintaining diaphragm 22 in its closed position, seen in FIG. 2. Preferably, cover member 12 is welded to sidewall 39 so as to form a single unit.

Figure 3:
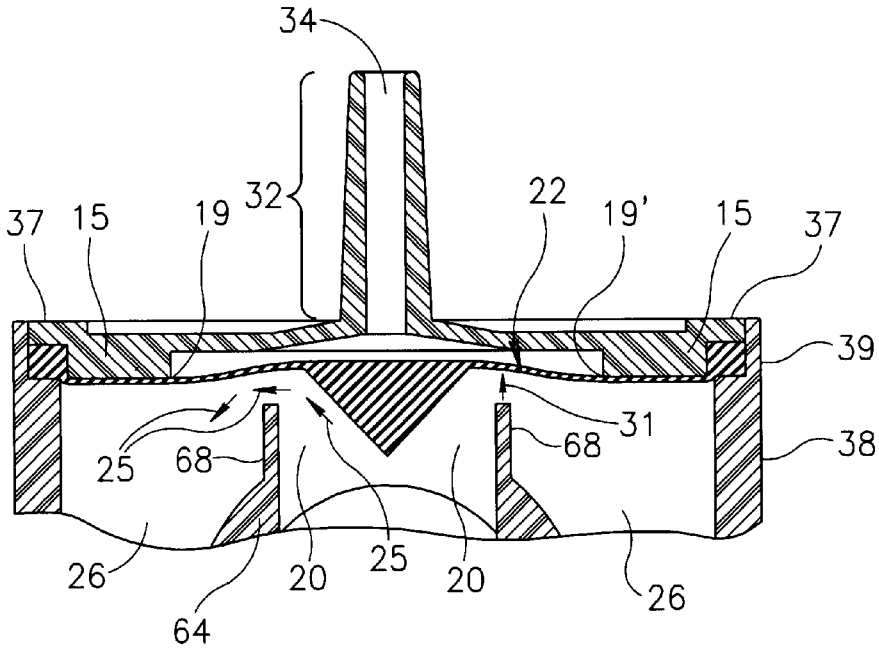
FIG. 3 is a similar view to that of FIG. 2, but showing the flexible diaphragm in an open position.
Figure 4:
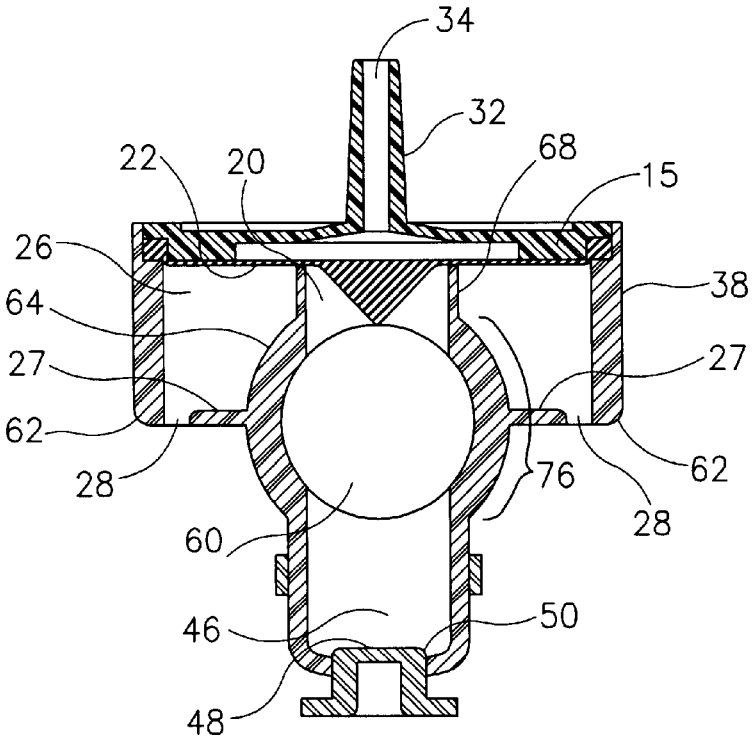
FIG. 4 is a cross-sectional view of the valve assembly of FIG. 1, taken along line 4—4 therein.

Referring now generally to FIGS. 1, 2, 3, and 4, conduit 18 (FIG. 1) has formed integrally therewith, a generally curved side wall 76 (FIG. 4), which surrounds discharge port 20, so as to form thereabout a chamber, referenced generally 26, into which exhaled air passes along a path generally indicated by arrows 25 (FIG. 3), when discharge port 20 is uncovered. Referring now specifically to FIG. 4, a lower portion of chamber 26 is partially closed by a pair of typically coplanar laterally extending flanges 27. Generally slit-like openings 28 are formed between the flanges 27 and the lower portions 62 of chamber side walls 38, through which exhaled air, present in chamber 26 vents into the atmosphere.

Figure 5:
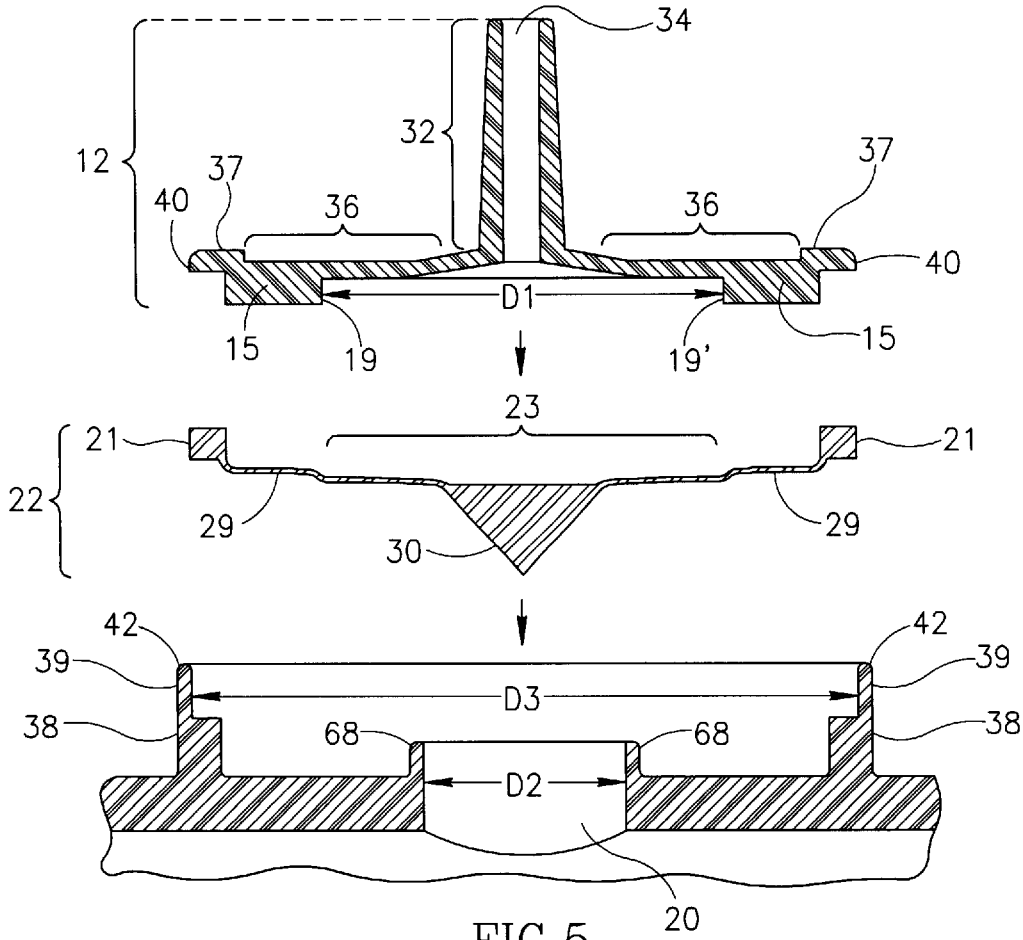
FIG. 5 is an exploded view of the portion of the valve assembly shown in FIG. 2.

Now referring to FIGS. 2 and 3, chamber side wall 38 terminates in an annular rim 39, which is formed so as to receive therein, in mating assembly, a stepped edge portion 37 of cover member 12, seen also in FIG. 5. It is further seen in FIG. 5, that edge portion 37 of cover member 12, and annular rim 39 of chamber side wall 38 are formed so as to retain therebetween an edge portion 21 of diaphragm 22, such that diaphragm 22 is held in position over discharge port 20. Cover member 12 has formed thereon an inward-facing shoulder portion 15, appearing in the drawing to be extending downwardly from cover member 12 towards conduit 18 (FIG. 1). Shoulder portion 15 extends outwardly towards annular rim 39, as described above, and also extends inwardly having its inner diameter between bending edges 19 and 19' of "D1" (FIG. 5).

Referring now specifcally to FIG. 5, discharge port 20 has an outward-facing circular rim 68 appearing in the drawing to be depending upwardly towards cover member 12, and having an inner diameter "D2," smaller than diameter D1 of shoulder portion 15. While edge portion 21 of diaphragm 22 is firmly held between cover member 12, a central portion of diaphragm 22, designated 23, is disposed so as to selectably cover and seal discharge port 20, in response to a pressure differential across diaphragm 22. Displacement of central portion 23 of diaphragm 22 is limited in a first direction, hereinafter referred to as the negative direction, indicated by arrow 31 (FIG. 3), by shoulder portion 15. When diaphragm 22 is displaced in the negative direction, and the outer closing portion 29, of its diameter is in contact with shoulder portion 15, this free central portion 23 of diaphragm 22 bends about bending edges 19 and 19'. During this displacement, the working diameter of diaphragm 22 is that of D1, as described above.

Referring now also to FIG. 2, when pressure is present at servo connection 32, and diaphragm 22 is displaced in a second, opposite direction, hereinafter referred to as the positive direction, its working diameter includes the extended servo space 66 between shoulder portions 15 and flexible diaphragm 22. The working diameter of diaphragm 22 during displacement in the positive direction, is the largest of the working diameters "D3" described herein and can be seen in FIG. 5. Further displacement of the diaphragm is prevented by outward-facing circular rim 68.

As seen in FIG. 3, in the presence of at least a minimum predetermined pressure differential across flexible diaphragm 22, such as when a patient to whom assembly 10 is connected, exhales, diaphragm 22 is displaced in the negative direction, away from port 20, as seen by arrow 31. This permits discharge of exhaled air to the atmosphere, via muffling chamber 26 and slit-like openings 28 (FIG. 4).

As described above, and as seen in FIG. 5, flexible diaphragm 22 is provided with an integrally formed, added mass 30. Added mass 30 serves to damp oscillation of the diaphragm, that is, to reduce it's natural frequency, such as characterize thicker diaphragms, as known in the art, while not diminishing from advantages provided by the use of a relatively thin, flexible diaphragm 22, shown and described herein in conjunction with a preferred embodiment of the present invention.

It will be appreciated, by those skilled in the art, that the fact that servo chamber 44 is sealed in a manner that neither requires nor admits of disassembly, avoids a known problem, characteristic of prior art valves, namely, that of incorrect reassembly after sterilization, causing malfunctional and dysfunctional performance of the valves. The provision of sealed servo chamber 44 avoids this problem and maintains consistent integrity of functionality always, except and unless the exhalation valve is actually purposefully disassembled.

Referring now generally to FIGS. 2, 3, and 5, it will be appreciated by those skilled in the art, that shoulder portions 15, effectively reduce the volume of servo chamber 44 (FIG. 2). This serves to introduce a new working diameter D1 (FIG. 5) of the flexible diaphragm 22 which is operative during an exhalation portion of a respiratory cycle. Those skilled in the art will further appreciate that the operative transfer ratio during an exhalation "phase" (FIG. 3) will be a function of the ratio of D2 to D1 (FIG. 5). However, during a portion of a respiratory cycle that involves pressure being present at servo connection 34, the applicable transfer ration is a function of diameter D3 to D2. This variable transfer ratio applicable during different phases of a respiratory cycle is a unique and essential part of the present invention.

During an inhalation phase of a respiratory cycle, when transfer ratio D3:D2 is applicable, this ratio is approximately 8. During an exhalation phase of a respiratory cycle, when transfer ratio D2:D1 is applicable, this ratio is approximately 5. Those skilled in the art will appreciate that this differential in transfer ratios enables a feature, as yet unknown in the art, of exhalation against resistance. That is, pressure at connection member 34 can be maintained while the patient exhales. The pressure at connection member 34 can also be set to a predetermined desired value, and the differential of transfer ratios allows this predetermined value to be maintained without being exceeded. Valves known in the prior art generally had only fully open and completely closed operating positions The present invention allows for intermediate positions; and, in addition, for maintaining these predetermined intermediate pressure settings, due to the greater sensitivity and response to pressure that differential transfer ratios afford.

Referring now to FIG. 4, there is provided a temperature monitoring port 46 at a position illustrated herein as being diametrically opposite that of the location of servo connection inlet 34 (FIG. 4).

Figure 6:
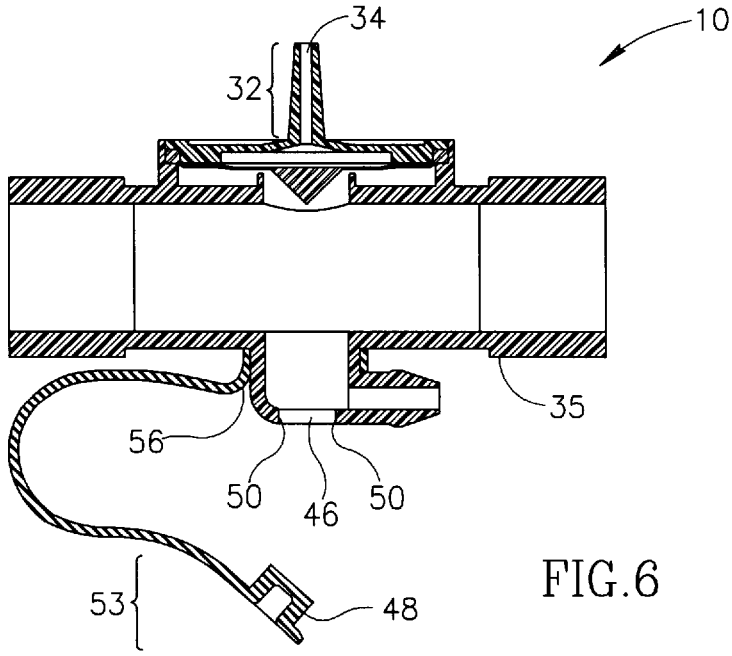
FIG. 6 is a cross-sectional view of the exhalation valve assembly showing a servo connection sealing plug thereof in a non-attached position.

Referring now to FIG. 6, a dual purpose sealing plug 48 constructed of rubber, plastic, or other pliant substance, for example, is operative to seal temperature monitoring port 46 when this port is not in use for monitoring purposes. This is done by inserting servo connection sealing plug 48 into temperature monitoring port 46 and seating servo connection sealing plug 48 firmly at location 50. Servo connection sealing plug 48 is configured to be removed from temperature monitoring port 46 and to seal servo pressure connection inlet port 34, as described below.

Referring now to FIG. 1, when no pressure is applied at servo connection 12, and, optionally, the delivery of a stream of compressed air, to air inlet port 14 (FIG. 1), is stopped as well, and the patient exhales; this gives rise to a negative pressure gradient across flexible diaphragm 22 causing it to be deflected in the negative direction, away from discharge port 20, thus allowing discharge of the patient's exhalation through discharge port 20.

Referring now generally to FIGS. 3 and 4, gas discharged via discharge port 20 now enters muffling chamber 26 where it expands and diffuses, and subsequently exits to the atmosphere external to the apparatus through dual discharge slits 28 (FIG. 4). Muffling chamber 26 is operative to muffle audible sound in a manner similar to the mufflers commonly in use in automobiles.

Again referring to FIGS. 3 and 4, muffling chamber 26 receives patient exhalation from discharge port 20 when flexible diaphragm 22 is in the open or uncovered position as seen in FIG. 3. Muffling chamber 26 is separated from discharge port 20 by diaphragm seating support members 68, as also seen in FIG. 3.

Referring now again to FIG. 1, the provision of flexible diaphragm 22 with added mass 30 provides for a reduced natural frequency of vibration of diaphragm 22, relative to a similar diaphragm without added mass 30. Accordingly, during the discharge phase of the respiration cycle, the frequency of the vibrations of the flexible diaphragm 22, when the discharge exhalation air is flowing past it, is sufficiently low so as to be in a frequency range which is preferably lower than approximately 20 Hz, so as to be non-audible to the human ear. This serves to effectively eliminate audible noise associated with conventional exhalation valves, which normally have a diaphragm which vibrates with a frequency within the audible range, being noisy and bothersome during operation. The addition of added mass 30 in flexible diaphragm 22 thus obviates the need to use a diaphragm of greater thickness. Moreover, by using a diaphragm of relatively thin general construction in this manner, the diaphragm of the invention also has much greater flexibility, and thus quicker response time than many thicker diaphragms in use in the current state of the art.

It will be appreciated by persons skilled in the art that the scope of the present invention is not limited by what has been shown and described above. Rather, the scope of the invention is limited solely by the claims, which follow.

What is claimed is:

1. An exhalation assembly which includes:

a hollow flow-through body, having an air inlet port and an air outlet port, wherein said inlet port is arranged to receive air for supplying to a patient, and said air outlet port is arranged to provide air to a patient; and an exhalation valve connected to said flow-through body, for facilitating selectable exhalation by a patient to whom air is being supplied, wherein said exhalation valve includes:

an air exhalation port arranged to permit therethrough an outflow of exhaled air;

a valve member arranged to selectably cover said exhalation port in response to a closure pressure applied thereto, and to uncover said exhalation port in response to an exhalation pressure applied thereto from said flow-through body through said exhalation port; and a pressure source for selectably applying a closure pressure to said valve member;

wherein said valve member is operative to cover said exhalation port in response to at least a minimum closure pressure which has a greater magnitude than an opposing a exhalation pressure; and means for changing the effective working area of the valve member from a first working area to a second working area which differs from said first working area.

2. An exhalation assembly according to claim 1, wherein said valve member is a flexible diaphragm, and said exhalation valve also has a housing formed integrally with said flow-through body, wherein said housing has a closure pressure inlet port associated with a working pressure source, and is arranged so as to receive air from said flow-through body through said exhalation port, and wherein said housing further has formed therein first and second diaphragm seating portions configured to support said flexible diaphragm therebetween;

and wherein said first valve seating portion is configured to support a first portion of said flexible diaphragm when said flexible diaphragm is in said uncovered position, and said second valve seating portion is configured to support a second portion of said flexible diaphragm when said flexible diaphragm is in said covered position.

3. An exhalation assembly according to claim 2, wherein the effective working areas of said first and second portions of said flexible diaphragm are said first and second working areas, and wherein a transfer force ratio is defined as a ratio of resistance to exhalation force such that, when said diaphragm is moving from said covered to said uncovered position and from said uncovered position to said covered position, respective first and second transfer force ratios are predetermined.

4. An exhalation assembly according to claim 3 wherein said first transfer force ratio is less than said second transfer force ratio.

5. An exhalation assembly according to claim 4 wherein said first transfer force ratio is approximately 5:1 and said second transfer force ratio is approximately 8:1.

6. An exhalation assembly according to claim 2 and including a housing portion surrounding said closure pressure inlet port, so as to define together with said flexible diaphragm a servo chamber, and wherein said servo chamber housing is constructed with an annular rim member depending therefrom and internal to said servo chamber, and wherein said annular rim member includes a shoulder portion and a sidewall portion, said shoulder portion being parallel to the plane in which said flexible diaphragm is mounted and said sidewall portion extending angularly from said shoulder portion, and wherein said flexible diaphragm has a central portion of varying thickness, surrounded by an annular portion of generally uniform thickness, and wherein said flexible diaphragm is mounted between an annular rim constructed to retain an edge portion of said diaphragm, and said housing formed with said first and second diaphragm seating portions whereby said flexible diaphragm is s supported, and wherein said flexible diaphragm, when moving from said covered position to said uncovered position, undergoes a first lateral displacement towards said closure pressure inlet port, and wherein while undergoing said first lateral displacement, said annular portion of said flexible diaphragm engages said shoulder portion so as to be prevented from further lateral displacement.

7. An exhalation assembly according to claim 6 further including means for permitting rapid movement of said flexible diaphragm from said covered position to said uncovered position.

8. An exhaltation assembly according to claim 7, said means for permitting rapid movement of said flexible diaphragm including means for reducing the size of said servo chamber.

9. An exhalation assembly according to claim 1, and also including apparatus for damping oscillation of said flexible diaphragm.

10. An exhalation assembly according to claim 9, wherein said apparatus for damping includes an added mass formed on said first portion of said flexible diaphragm.

11. An exhalation assembly according to claim 10, wherein said flexible diaphragm has a resonant frequency substantially below the normal range of human hearing.

12. An exhalation assembly according to claim 1 and including a housing formed about said air exhalation port so as to define a muffling chamber, and operative to permit a flow of exhaled air from said exhalation port to said muffling chamber.

13. An exhalation assembly according to claim 12 wherein said housing that delineates said muffling chamber has formed therein a plurality of recessed discharge slits thereby facilitating discharge of exhaled air.

14. An exhalation assembly according to claim 1 wherein said hollow flow-through body has at least one monitoring port for monitoring gas parameters, formed integrally and arranged in gas flow communication therewith.

15. An exhalation assembly according to claim 14 and including a cover element for selectably closing said monitoring port.

16. An exhaltation valve according to claim 15 wherein a transfer force ratio is defined as a ratio of resistance to exhaltation force such that, when said diaphragm is moving from said covered to said uncovered position, the transfer force ratio is predetermined, and wherein said flexible diaphragm is responsive to a first closure pressure applied from said pressure source, in conjunction with said transfer force ratio, to determine the magnitude of a first exhalation pressure required to move said flexible diaphragm to said uncovered position.

17. An exhalation valve assembly according to claim 16 wherein said flexible diaphragm is further operative, in response to at least one further closure pressure having a magnitude different to said first closure pressure and wherein said further closure pressure is operative to determine the magnitude of a further exhalation pressure, said further exhalation pressure having a magnitude different to said first exhalation pressure, required to move said flexible diaphragm to said uncovered position.

* * * * *